United States Patent [19]

Bettenhausen et al.

[11] 4,011,977

[45] Mar. 15, 1977

[54] TAPE HANDLING APPARATUS

[75] Inventors: Larry A. Bettenhausen, West Lakeland Township, Washington County; James H. Casey, Roseville, both of Minn.; Robert A. Luhman, Cylon Township, St. Croix County, Wis.

[73] Assignee: Minnesota Mining and Manufacturing Company, St. Paul, Minn.

[22] Filed: Sept. 25, 1975

[21] Appl. No.: 616,641

Related U.S. Application Data

[62] Division of Ser. No. 436,874, Jan. 28, 1974, Pat. No. 3,929,552.

[52] U.S. Cl. ..... 226/88; 156/461; 156/467; 226/156

[51] Int. Cl.[2] ..... B65H 23/34

[58] Field of Search ..... 156/461, 467, 200–201, 156/204, 521, 519, 520, 510, 584, 344, 540–542; 226/88, 93, 196, 8; 428/189–191, 126

[56] References Cited

UNITED STATES PATENTS

| | | | |
|---|---|---|---|
| 1,967,579 | 7/1934 | Krueger | 226/88 X |
| 2,317,576 | 4/1943 | Avery | 156/584 X |
| 2,556,443 | 6/1951 | Renne | 156/576 X |
| 3,697,356 | 10/1972 | Kuts | 156/467 |

FOREIGN PATENTS OR APPLICATIONS

| | | | |
|---|---|---|---|
| 447,065 | 5/1936 | United Kingdom | 226/88 |

*Primary Examiner*—David A. Simmons
*Attorney, Agent, or Firm*—Cruzan Alexander; Donald M. Sell; John C. Barnes

[57] ABSTRACT

An applicating machine for applying short lengths of flexible fibrous material having an adhesive coating to a surface. The applicator uses a pair of fingers to hold the fibrous material onto the surface of an applicating pad and a rod to strip the material from the fingers. The fingers are initially spaced from the pad to permit a measured length of flexible material to be moved between the pad and the fingers. The fingers are then retracted to a closed holding position. The fingers support the length of material during the severing of a short length of material by cutting means and while the applicating pad transports the severed strip to the surface for application. The measured length of the flexible material to be dispensed and applied, the applicating pad, and the fingers are moved downward the severed length of fibrous material being applied to a product. A reciprocating push rod places pressure on a portion of the applied flexible material holding the material against the product while the fingers and the pad are retracted. The fingers move to a lowered position to receive another length of fibrous material.

2 Claims, 7 Drawing Figures

TAPE HANDLING APPARATUS

This is a division of application Ser. No. 436,874 filed Jan. 28, 1974, now U.S. Pat. No. 3,929,552.

BACKGROUND OF THE INVENTION

1. Field of the Invention

This invention relates to an applicator for an adhesive product and in one respect to an apparatus for handling an adhesive tape product having a porous, fibrous or lofty surface opposite the adhesive.

2. Description of the Prior Art

The handling of tape or ribbons, which must be unwound from a roll and advanced to a cutter, is generally done by pulleys or rollers with flanges or by moving the same along a surface having a guide on one edge. Such devices are known in the art. These devices control the tape. They do not control the movement by depending on the tape structure as an element in the guiding function. By such rigidity in the handling the tape may become misaligned and leave the desired path.

The present invention provides a system for guiding the tape by fluxing edges of the tape to form guide edges to follow the edges of a planar guide member.

The material which is to be handled by the apparatus of the present invention is a tape material having a surface which cannot be held by application of a subatmospheric pressure to the surface, i.e., a porous, fibrous or lofty surface secured to a backing or base material and a surface coated with a pressure-sensitive adhesive opposite the lofty surface. A release liner is generally placed over the pressure-sensitive adhesive permitting the material to be convolutely wound. The specific construction of the tape to which the present invention is directed is claimed and described in U.S. Pat. No. 3,009,235 issued Nov. 21, 1961 to G. Mestral, the disclosure of which relates to a fibrous tape material and is incorporated herein by reference.

SUMMARY OF THE INVENTION

In machines which handle tape material for applying cut lengths thereof and the like the present invention provides an improved tape guiding system. The tape is moved from a roll on a support. The tape is convolutely wound in a loose roll and is to be moved along a path. The tape is a flexible fibrous material having a backing, on one surface of which is a lofty fibrous surface and on the other of which is a pressure-sensitive surface protected by a release liner having a width greater than that of the backing and extending outward from each side of the backing along the length thereof. The tape material is advanced around a guide spool-shaped roller and directed onto a platen. The platen has a width equal to that of the backing of the tape material. A guide roller of spool shape, having a depressed area at the center thereof of a width substantially equal to the width of said platen, is supported to be biased toward the platen so that the edges of the liner are folded or bent down along the edges of the platen to be guided thereby. The tape is pulled past the guide roller by a drive roller having a toothed outer peripheral surface to engage the fibrous surface of the tape. The liner is directed about an end of the platen to be peeled from the adhesive surface and to direct the tape therebeyond toward a cutter.

DESCRIPTION OF THE DRAWING

An illustrative embodiment of the present invention is described with reference to the accompanying drawing wherein.

DESCRIPTION OF THE PREFERRED EMBODIMENTS

Figure 1:
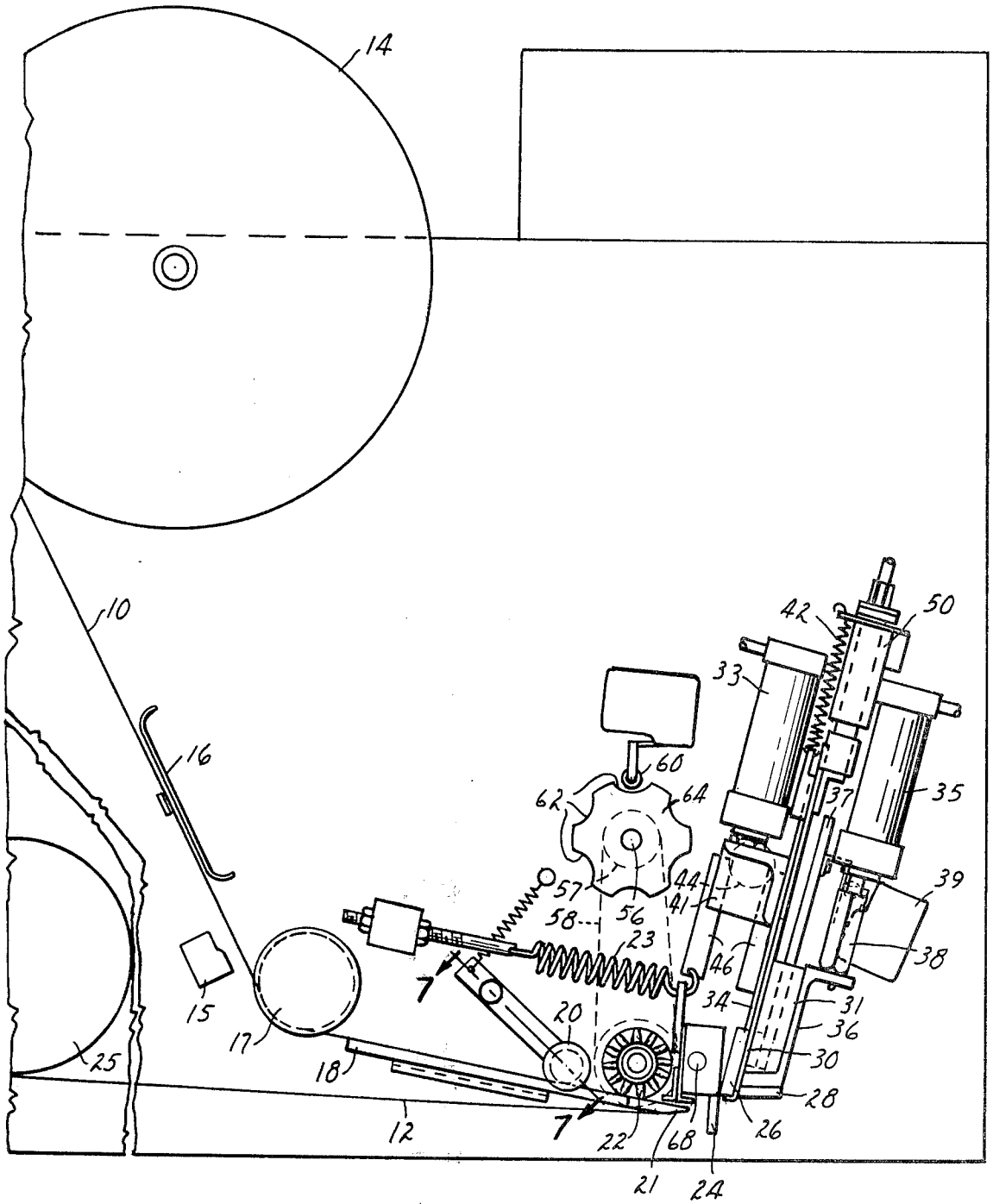
FIG. 1 is a side elevational view of an applicating machine constructed in accordance with the present invention.
Figure 2:
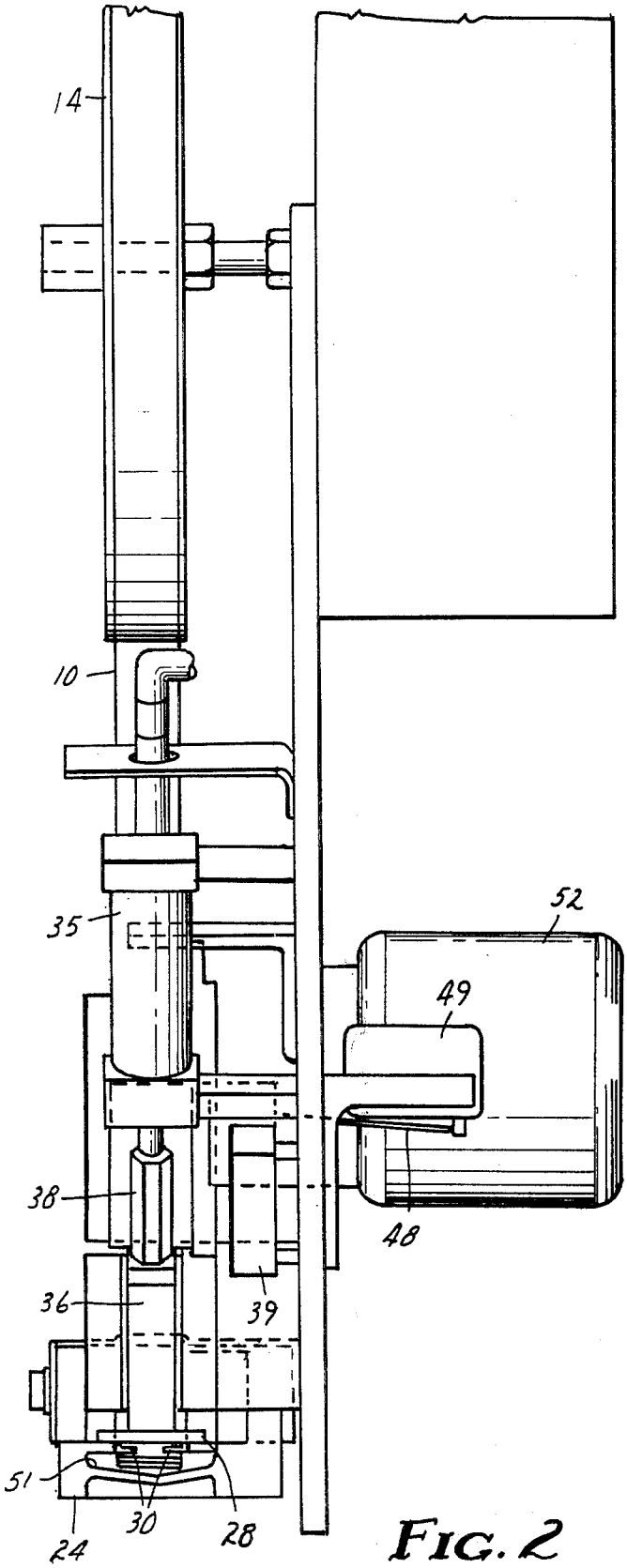
FIG. 2 is an end view of the applicating machine.
Figure 7:
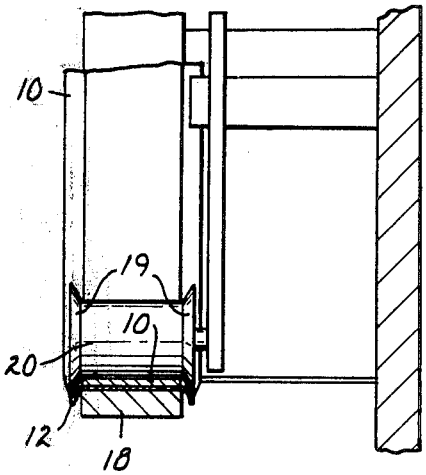
FIG. 7 is a sectional view of FIG. 1 taken along the line 7—7.
Figure 3:
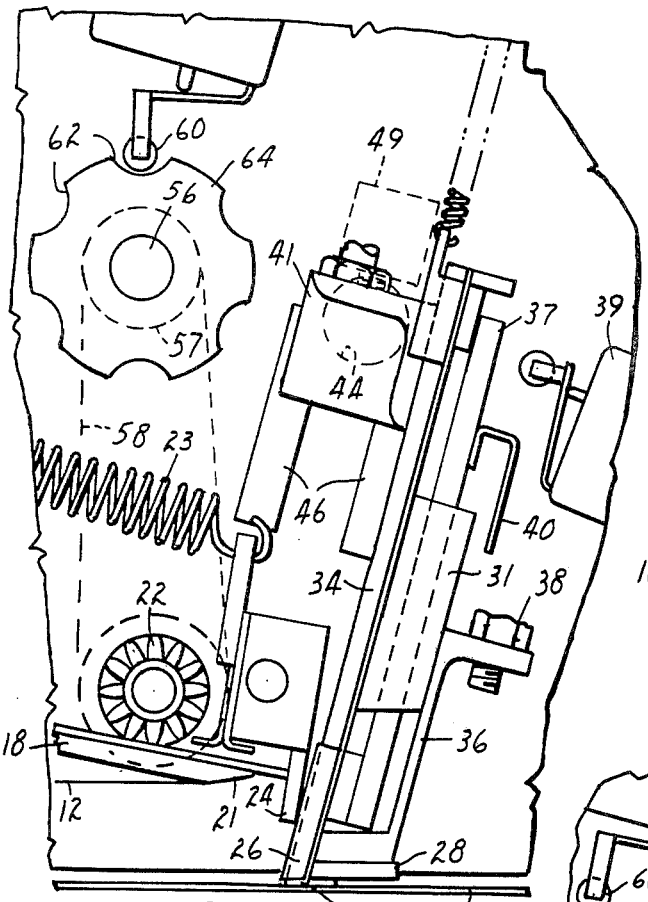
FIG. 3 is an enlarged fragmentary view of the cutting and applicating head with the same in an applying position.
Figure 5:
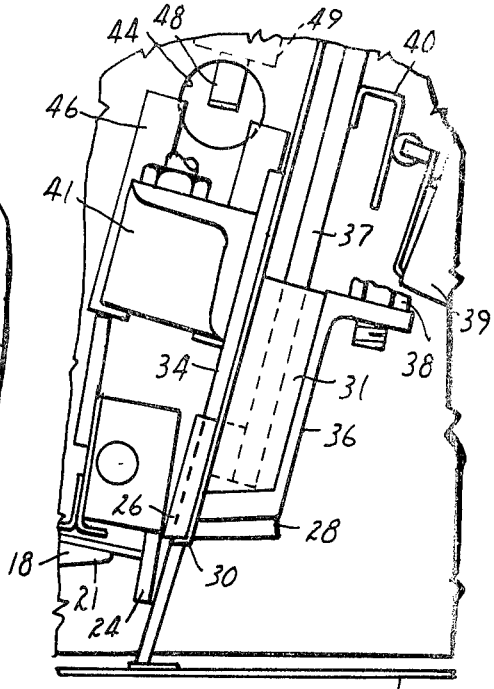
FIG. 5 is an enlarged fragmentary view showing the applicating pad and fingers in a retracted position with the pusher rod in the lowered position.
Figure 4:
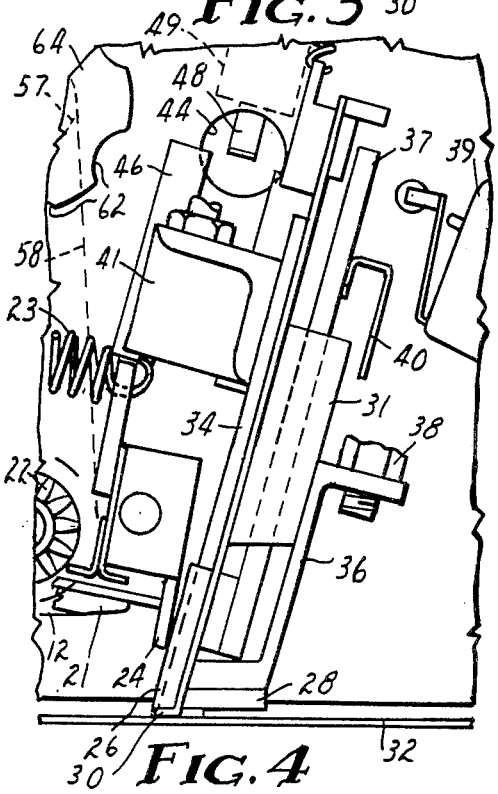
FIG. 4 is an enlarged fragmentary view similar to FIG. 3 but showing the parts with the push rod in the lowered position.
Figure 6:
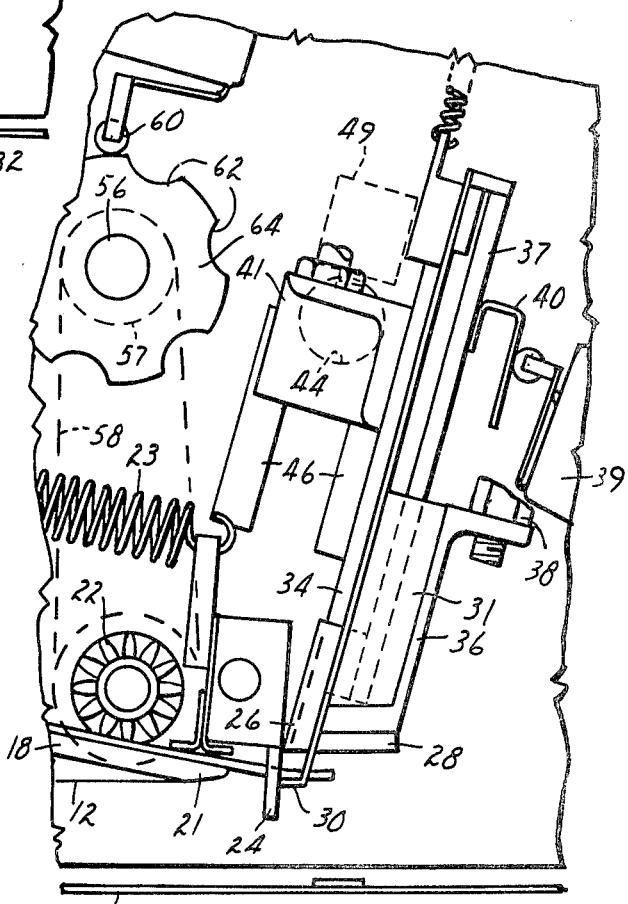
FIG. 6 is a fragmentary detail view of the applicating pad in the material feed position.

In general, a strip of flexible fibrous material 10 comprising a backing with a porous material secured on one side and having a pressure-sensitive adhesive disposed on the side opposite the porous material and a release liner 12 surfacing said adhesive, said liner being wider than the width of said fibrous material, is fed from a supply roll 14 and passes through a metal ski-shaped guide 16 and around a guide spool-shaped roller 17 under mild tension. The material 10 then passes along a platen 18 and under a second spool shaped roller guide 20. The width of the platen and the depressed area at the center of the roller 20 are equal to the width of the fibrous material and less than the liner 12 so that the edges of the liner are folded or bent down along the edges of the platen to be guided thereby. A feed roller 22 having a plurality of teeth engaging the lofty fibrous material 10 rotates pulling the material 10 from the supply roll 14. The material being fed is directed from the platen over the cutting edge of a pivoting shear blade 24. The pivoting shear blade 24 cooperates with a second shear blade 26 to sever the material 10 as a pad 28 and fingers 30 of the apparatus push a measured length of the fibrous material down towards a receptor surface or product 32 to which the measured length of material is to be applied. After the pad 28 has pressed the severed material against the product 32 a push rod 34 descends and retains the severed fibrous material in contact with the product while the fingers 30, the shear 26 and the pad 28 are retracted. The push rod 34 is then retracted leaving the fibrous material in contact with the product. After the severed fibrous material has been applied to the product it is desirable that the applied material be pressed, that is additional pressure applied to the entire surface of the material, to insure all the pressure sensitive adhesive has made contact with the underlying product 32.

In greater detail, material 10 from the supply roll 14 passes under the metal ski shaped guide 16 under a light tension which keeps the material in a straight line past a photoelectric cell 15. The photoelectric cell 15 will sense when a splice or other imperfection is present in the material 10 or the end of the material has come off the supply roll 14. This allows a new roll of material to be spliced or fed into the machine before the machine empties and prevents the machine from being jammed by the small pieces of residual material which would otherwise be formed and fall into the machinery. The fibrous material 10 passes under the guide roller 17 which has a reduced section suitable for receiving the fibrous material, the fibrous material is then drawn onto the platen 18. The liner 12 is sufficiently wider than the fibrous material 10 that the edges of the liner projecting past the edges of the material will overlap the edges of the platen and flanges or rims 19 of the second guide roller 20 will physically bend the edges of the liner over the platen forming a U-shaped configuration. This insures the fibrous material 10 will move in a straight line under and past the feed roller 22. At the end 21 of the platen 18 the liner 12 is peeled from the material 10, and the material 10 will be fed in a straight line between the cutting edges of the shear blades 24 and 26, and between the applicating pad 28 and the spaced fingers 30. The removed release liner 12 is wound on take-up roll 25.

At the start of an application cycle the fingers 30 are raised, by a spring 42, holding the end of material 10 against the underside of applicating pad 28. The applicating pad 28 is a plate having a smooth lower surface and is secured to a bracket 36 mounted to a rod 37 which moves in a channel in block 31 secured to a supporting frame. The bracket 36 is also secured to the blade 26 so the blade moves in conjunction with the pad 28 and the fingers 30 are also in contact with the blade 26. Upon activation of a double acting cylinder 35 connected to the bracket 36 by an extension 38, the bracket 36, pad 28, fingers 30 and the shear blade 26 move downward severing the flexible material 10 between reciprocating blade 26 and shear blade 24 which is biased into engagement therewith by a tension spring 23 pivoting the blade 24 about an axis 68. As reciprocating blade 26 moves downward the shear blade 24 rotates so that the shearing edges are in contact providing a clean shearing action. After the pad, fingers and the blade are in the applicating position, a switch is opened to actuate a cylinder 33 causing the push rod 34 to descend through a channel in the blade 26 to hold the severed portion of fibrous material 10 at its center between the fingers 30 insuring a portion of the fibrous material remains in contact with the product 32 during withdrawal or return of the fingers, blade 26 and pad 28. After the push rod 34 has descended a time delay mechanism actuated by a time delay relay in the pad circuitry activates cylinder 35 retracting bracket 36, pad 28 and blade 26 to a raised position. The fingers 30 are pulled to a raised position by the slide 37. As the bracket 36 is raised cam 40 on rod 37 activates switch 39 which in turn actuates the push rod cylinder 33 retracting the push rod 34.

Cylinder 33 then retracts the push rod 34 leaving the fibrous material firmly attached to the product 32. As the push rod 34 is retracted by the cylinder 33 the bracket 41 supporting the push rod 34 has a circular cam follower (not shown) which is guided in a race formed by slides 46 and activates a switch lever 48 projecting through aperture 44 which closes the switch 49 to in turn activate the cylinder 50 and start a motor 52. Cylinder 50 pushes the fingers 30 down away from the underside of pad 28 to a spaced position about ½ inch below the pad or to a feed position where material 10 passing through the V-shaped opening 51 in the shear blade 24 will be above the fingers. The motor 52 then turns a drive shaft 56 and sprocket 57 driving a belt 58 and a sprocket attached to the feed roller 22 thereby advancing the material through the shear blade 24 until a cam follower on a switch 60 drops into the next indentation 62 of cam 64 which kicks out a relay and turns off the motor. The fluid pressure to cylinder 50 is also interrupted and the fingers 30 return upward because of the bias of spring 42 and the apparatus is ready to cut and apply another strip of material. Attachment of an oiling wick which contacts the lower edge of shear blade 26 when said blade is in the rest position will lubricate the blades with every stroke and aid the proper functioning of the apparatus. The length of material fed onto the application pad is determined by the size of the feed roller 22, the distance between cam lobes 62, size of cams, sprockets, etc. The length to be applied can be varied greatly; however, this apparatus is particularly suitable for short strips, e.g. ¼–1 ½ inch pieces, more specifically ⅜ to ½ inch, which are useful as envelope closures, etc.

The preferred shearing mechanism of the applicating apparatus of this invention comprises two members, a first reciprocating shear blade and a second pivoted shear blade. The reciprocating shear blade has a straight cutting surface which moves at an angle to the vertical and is actuated downward by a reciprocating air driven cylider 35 as described hereinbefore. The second pivoting shear blade is spring biased and has a V-shaped cutting edge on the lower side of an aperture 51 which allows material to pass through easily. Upon downward motion of the reciprocating shear blade the pivoting shear blade will pivot about shaft 68 to bring the side of the blade 24 into contact and parallel alignment with the blade 26.

One example of a similar shearing apparatus for severing pressure sensitive adhesive tapes is disclosed in U.S. Pat. No. 3,472,724 issued Oct. 4, 1969 to Casey. The disclosure with respect to the action of the shearing blades and the shape of the V-shaped aperture is incorporated herein by reference.

Having described the invention with respect to a particular embodiment, it is to be understood that modification may be made without departing from the scope of the invention.

What is claimed is:

1. In a machine for handling a length of tape comprising a backing, a pressure-sensitive adhesive coating on one surface of said backing, a lofty fibrous surface on said backing opposite said adhesive coated surface, and a release liner applied to said adhesive coated surface, said liner having a width greater than that of said backing and extending outward from each side of said backing along the length thereof, the combination of a platen for supporting said tape, said platen having a width not exceeding that of said backing, a guide roller engageable with said fibrous surface to hold said tape on the platen, said roller having radially extending end flanges positioned along the edges of the platen to engage and bend the outward extending edges of said liner along the edges of said platen to guide said tape along said platen, and a driven roller having a toothed outer peripheral surface positioned above the platen with the toothed surface engageable with said fibrous surface of said tape to frictionally move said tape along said platen.

2. In a machine according to claim 1 wherein said flanges on said guide roller define a depressed area at the center of the roller of a width substantially equal to the width of said platen and including means for supporting said roller and for biasing said roller toward said platen.

* * * * *